US005704646A

United States Patent [19]

Tzeng

[11] Patent Number: 5,704,646

[45] Date of Patent: Jan. 6, 1998

[54] ORGANIZER COVER HAVING A LOOSE-LEAF HOLDER ATTACHED THERETO

[76] Inventor: Hsu-Shan Tzeng, 5, Alley 2, Lane 133, Pa-Te Street, Hsin-Chuang City, Taipei Hsien, Taiwan

[21] Appl. No.: 758,180

[22] Filed: Nov. 25, 1996

[51] Int. Cl.[6] ..... B42D 29/00

[52] U.S. Cl. ..... 281/29; 281/37; 281/51; 402/73

[58] Field of Search ..... 281/29, 31, 36, 281/37, 51, 15.1; 402/73, 70, 80 R

[56] References Cited

U.S. PATENT DOCUMENTS 5,013,068 5/1991 Maldonado ..... 281/29 X
5,020,828 6/1991 Moor ..... 281/29
5,527,069 6/1996 Bionco ..... 281/29 X
5,562,309 10/1996 Brink et al. ..... 281/29 X

*Primary Examiner*—Willmon Fridie, Jr.
*Attorney, Agent, or Firm*—Bacon & Thomas

[57] ABSTRACT

An organizer cover comprises a front cover, a back cover, and a loose-leaf holder for holding loose leaves. The front cover and the back cover are of a sacklike construction and are capable of holding therein a mono-phase or two-phase liquid. Located between the front cover and the back cover is a connection portion to which the loose-leaf holder is fastened. The front cover and the back cover are made of transparent or translucent plastic skin. The mono-phase or two-phase liquid contained in the front cover and the back cover may further contain small solid pieces. Various patterns are brought about on the surfaces of the front cover and the back cover when the mono-phase or two-phase liquid flows about in the interiors of the front cover and the back cover.

5 Claims, 3 Drawing Sheets

ORGANIZER COVER HAVING A LOOSE-LEAF HOLDER ATTACHED THERETO

FIELD OF THE INVENTION

The present invention relates generally to an organizer for arranging orderly the forthcoming events to help one remember the events or to remind one to do the events, and more particularly to an organizer having a cover which is provided with a loose-leaf holder attached thereto.

BACKGROUND OF THE INVENTION

As shown in FIG. 1, a prior art organizer cover 10 is made of a single-layered plastic skin and is composed of a front cover 15, a back cover 13, a connection portion 11 located between the front cover 15 and the back cover 13, and a loose-leaf holder 12 fastened with the connection portion 11 for holding leaves that can be easily removed or replaced. The back cover 13 is provided at the center of the long side thereof with a fastening strap 14 having a female retainer 17, whereas the front cover 15 is provided at the center of the margin of the long side thereof with a male retainer 16 corresponding in location to and engageable with the female retainer 17. As a result, the front cover 15 and the back cover 13 can be held together by the male retainer 16 and the female retainer 17 such that the loose leaves held by the loose-leaf holder 12 are well protected.

The prior art organizer cover 10 described above is limited in design in that the decorative effect of the cover 10 of the single-layered plastic skin can be attained only by printing, pressing or embossing, and that the decorative effect of the cover 10 is generally rather monotonous in nature, and further that the decorative effect of the cover 10 is unappealing in terms of marketability.

SUMMARY OF THE INVENTION

The primary objective of the present invention is therefore to provide an organizer cover which is effective in protecting the loose leaves held therein and is attractively designed to have an external appearance appealing to the consumers at large.

It is another objective of the present invention to provide an organizer cover which comprises a front cover and a back cover. The front cover and the back cover are of a closed sacklike construction and are either communicable or incommunicable with each other. The front cover and the back cover contain respectively the mono-phase or two-phase liquid capable of flowing freely in the sacklike covers for producing various patterns on the covers.

In keeping with the principle of the present invention, the foregoing objectives of the present invention are attained by an organizer cover, which comprises mainly a cover main body and a loose-leaf holder fastened securely to the center of the cover main body by a plurality of rivets such that a number of loose leaves can be held removably by the loose-leaf holder, and that the cover main body is divided by the loose-leaf into a front cover and a back cover, which are about equal in size to each other. The organizer cover of the present invention is characterized in that the cover main body is made of two superimposed layers of transparent or translucent plastic skin. The plastic skin is provided along the fringe thereof with a leakproof structure which is formed by the thermowelding of the two layers of plastic skin. Similarly, the rivets are provided on both sides thereof with the leakproof structure formed by the thermowelding of the two layers of plastic skin. As a result, the front cover and the back cover of the organizer cover of the present invention are of a closed sacklike construction and are therefore capable of containing the mono-phase or two-phase liquid.

It is preferable that the leakproof structures provided on both sides of the rivets have a shape capable of allowing the interiors of the front cover and the back cover to communicate with each other. However, the leakproof structures of the rivets may selectively have a shape capable of prohibiting the interiors of the front cover and the back cover to communicate with each other.

It is suitable to provide the back cover with a fastening strap attached thereto such that the fastening strap extends in a direction away from the fringe of the back cover, and that the fastening strap has a female retaining element. In the meantime, the front cover has a male retaining element corresponding in location to and engageable with the female retaining element of the fastening strap of the back cover. In fact, the fastening strap is an extension of the leakproof structure of the fringe of the plastic skin. The female retaining element of the front cover is surrounded by a leakproof ring formed of the plastic skin by thermowelding.

It is preferable that the mono-phase or two-phase liquid contains one or more kinds of solid substances, which are dispersed in the liquid.

The foregoing objectives, features, functions and advantages of the present invention will be more readily understood upon a thoughtful deliberation of the following detailed description of the embodiments of the present invention in conjunction with the accompanying drawings.

DETAILED DESCRIPTION OF THE EMBODIMENTS

Figure 1:
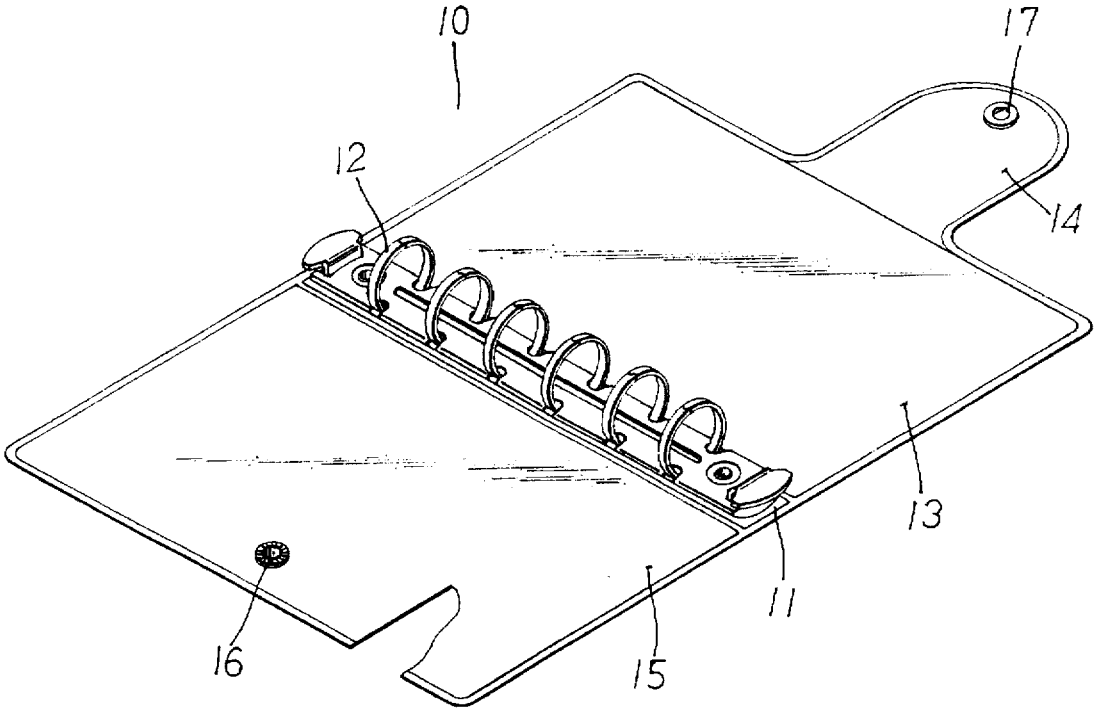
Fig. 1 (PRIOR ART)
FIG. 1 shows a perspective view of an unfolded organizer cover of the prior art.
Figure 2:
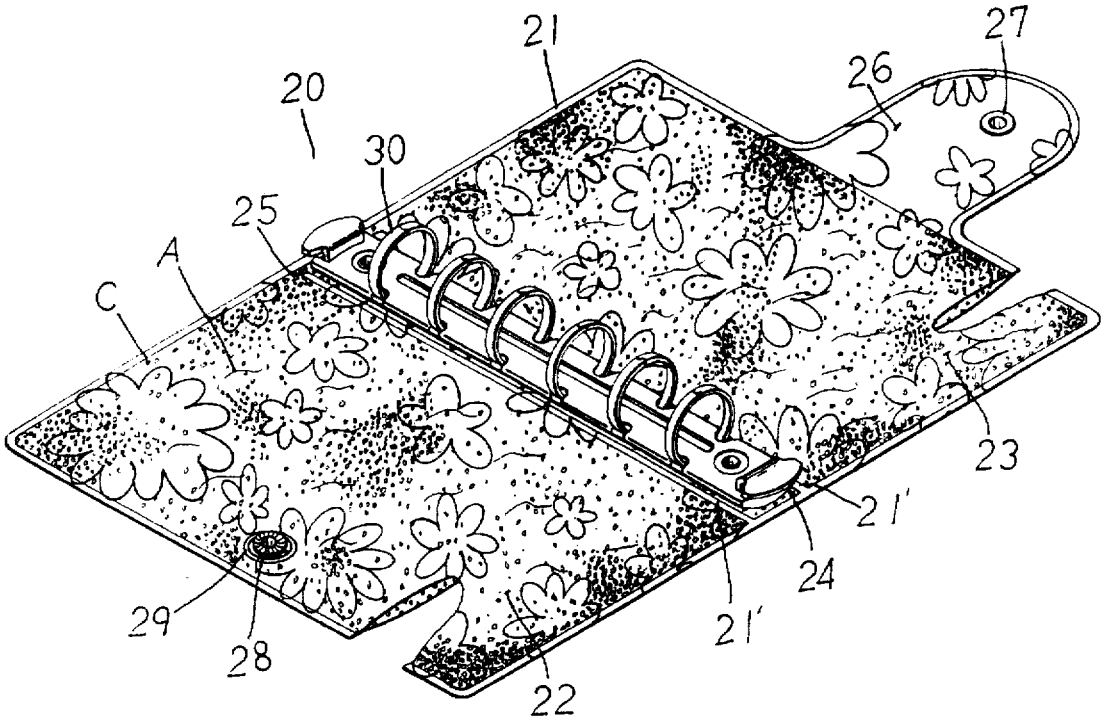
FIG. 2 shows a perspective view of an unfolded organizer cover of a first preferred embodiment of the present invention.

As shown in FIG. 2, an organizer cover of the first preferred embodiment of the present invention comprises mainly a rectangular cover main body 20 of a sacklike construction, and a loose-leaf holder 30 attached to the main body 20.

Figure 3:
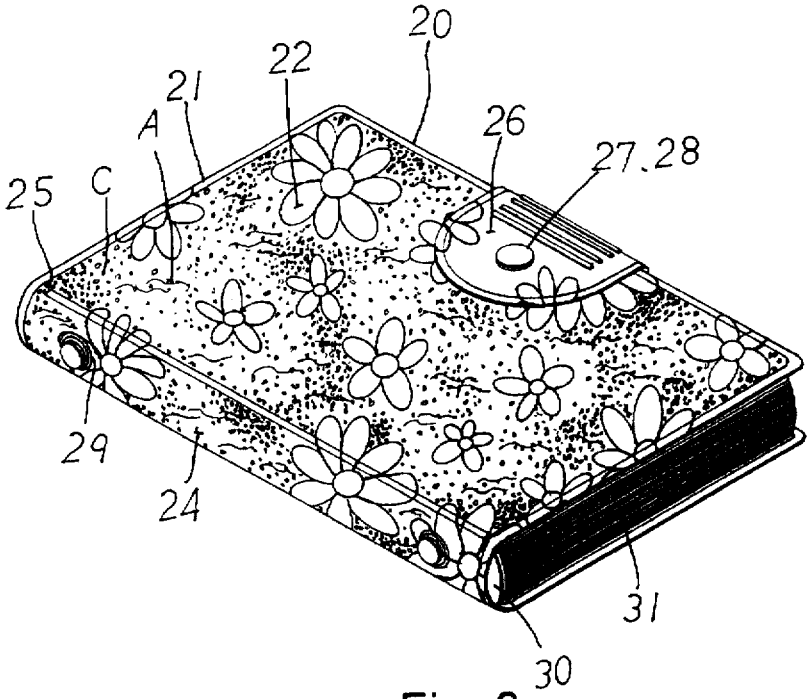
FIG. 3 shows a perspective view of a folded organizer cover of the first preferred embodiment of the present invention.

The cover main body 20 is made of two superimposed layers of transparent or translucent plastic skin and is provided along the fringe thereof with a leakproof strip 21 formed by thermowelding. The sacklike main body 20 contains water, which is designated by the letter "A" and is mixed with a number of aluminum flakes designated by the letter "C". The cover main body 20 is further provided at the center thereof with two leakproof strips 21' extending along both longitudinal sides of the loose-leaf holder 30 such that the cover main body 20 is divided into a front cover 22, a back cover 23, and a connection portion 24. The leakproof strips 21' may be provided with one or more indentations 25 intended to make the interiors of the front cover 22 and the back cover 23 communicate with each other. The back cover 23 is provided at the center of the longitudinal fringe thereof with a female retaining 27. The front cover 22 is provided with a male retainer 28 corresponding in location to and engageable with the female retainer 27. The male retainer 28 are surrounded by a leakproof ring 29. The loose-leaf holder 30 is fastened with the connection portion 24 by two rivets which are surrounded respectively by a leakproof ring 29, as shown in FIG. 3. The loose-leaf holder 30 is capable of holding an appropriate number of loose leaves 31.

The outer surface of the main body 20 of the organizer cover of the present invention is printed or embossing with various patterns for enhancing the decorative effect of the organizer cover.

Figure 4:
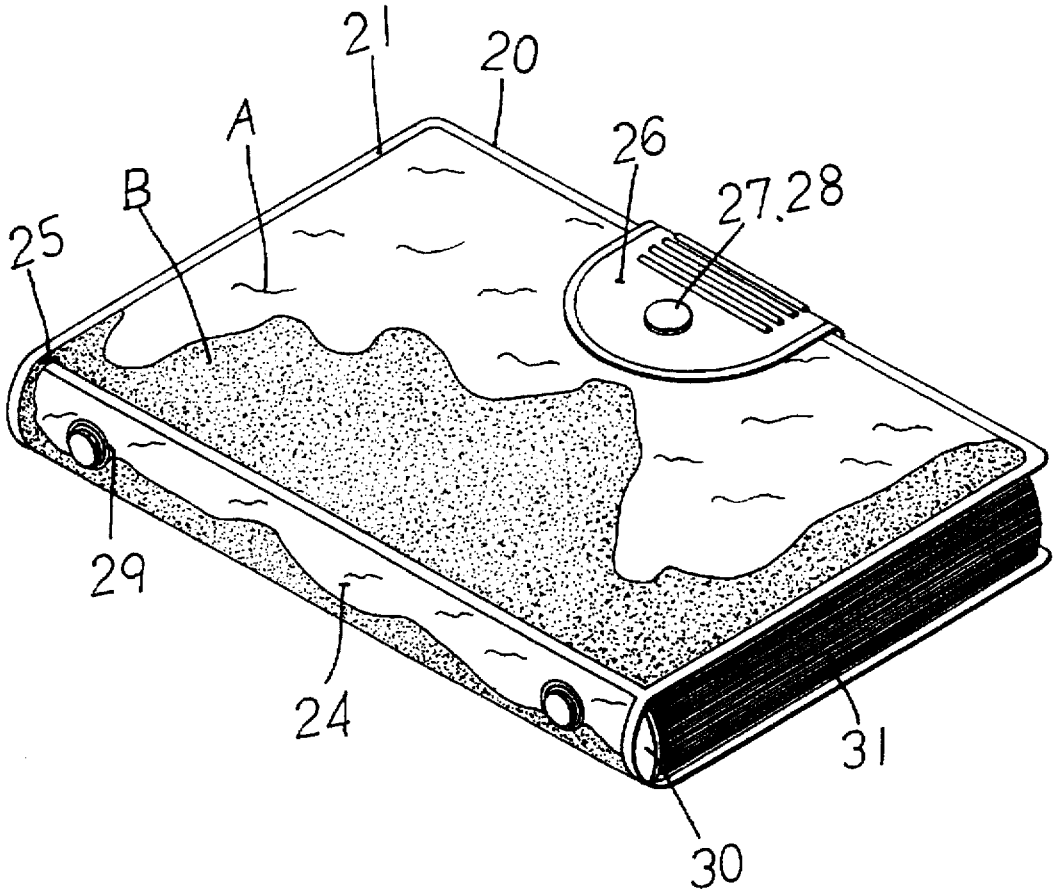
FIG. 4 shows a perspective view of a folded organizer cover of a second preferred embodiment of the present invention.

As illustrated in FIG. 4, an organizer cover of the second preferred embodiment of the present invention is different from that of the first preferred embodiment of the present invention in that the former comprises a main body 20 of a sacklike construction containing water A and aliphatic liquid B but being devoid of the aluminum flakes.

The embodiments of the present invention described above are to be regarded in all respects as being merely illustrative and not restrictive. Accordingly, the present invention may be embodied in other specific forms without deviating from the spirit thereof. The present invention is therefore to be limited only by the scope of the following appended claims.

What is claimed is:

1. An organizer cover comprising a main body and a loose-leaf holder fastened with said main body by a plurality of rivets such that said loose-leaf holder divides equally said main body into a front cover and a back cover; wherein said main body is made of two superimposed layers of transparent or translucent plastic skin and is provided respectively along a fringe thereof and on both sides of said rivets with a leakproof structure formed by thermowelding; and wherein said front cover and said back cover are sealed by said leakproof structures to become respectively a sack capable of containing a mono-phase or two-phase liquid.

2. The organizer cover as defined in claim 1, wherein said leakproof structures located on said both sides of said rivets have a shape capable of allowing interiors of said sacks of said front cover and said back cover to communicate with each other.

3. The organizer cover as defined in claim 1, wherein said leakproof structures located on said both sides of said rivets have a shape capable of prohibiting interiors of said sacks of said front cover and said back cover to communicate with each other.

4. The organizer cover as defined in claim 1, wherein said back cover has a fastening strap attached thereto such that said fastening strap extends from a fringe of said back cover in a direction away from said fringe, said fastening strap provided with a female retainer surrounded by a leakproof ring; and wherein said front cover is provided with a male retainer corresponding in location to and engageable with said female retainer of said back cover, said male retainer being surrounded by a leakproof ring formed by thermowelding.

5. The organizer cover as defined in claim 1, wherein said mono-phase or two-phase liquid has a plurality of solid substances dispersed therein.

* * * * *